United States Patent [19]

Ingemann

[11] Patent Number: 4,738,374

[45] Date of Patent: Apr. 19, 1988

[54] CONTAINER

[76] Inventor: Ole Ingemann, R nnebaervaenget 8, DK-5856 Ryslinge, Denmark

[21] Appl. No.: 897,140

[22] Filed: Aug. 15, 1986

[30] Foreign Application Priority Data

Aug. 16, 1985 [SE] Sweden ..... 8503830

[51] Int. Cl.[4] ..... B65D 51/22

[52] U.S. Cl. ..... 220/258; 220/270; 220/359

[58] Field of Search ..... 220/257, 260, 258, 359, 220/256, 270, 266, 267, 273

[56] References Cited

U.S. PATENT DOCUMENTS

| | | | |
|---|---|---|---|
| 4,328,905 | 5/1982 | Hardt | 220/258 |
| 4,533,063 | 8/1985 | Buchner et al. | 220/270 |
| 4,605,142 | 8/1986 | Itoh et al. | 220/359 |

*Primary Examiner*—Stephen Marcus
*Assistant Examiner*—Nova Stucker
*Attorney, Agent, or Firm*—Roberts, Spiecens & Cohen

[57] ABSTRACT

A container comprising a container body having an open top with a ring united in sealing and permanent connection with an anchorage portion of an outer lid. A second lid is sealingly fixed to the container body in a region inside the outer lid, whereby there is formed, in the factory-sealed container, a sealed space between the lids.

15 Claims, 8 Drawing Sheets

CONTAINER

FIELD OF THE INVENTION

The present invention relates to a resealable container with a lid and a container body which, in its opening portion, is provided with an anchorage portion which is sealingly and permanently connected to an anchorage portion on the lid. Apart from the above-mentioned lid, at least one second lid is sealingly fixed to the container body in a region inside the first lid, whereby there is formed, in the factory-sealed container, at least one sealed space between the lids.

BACKGROUND OF THE INVENTION

Containers of plastic material have steadily gained ground in employment for the storage of different products and, in particular, the storage of foods. Such containers must meet a number of requirements, including that they be easy to open and generally provide reliable and tight reclosure, that they guarantee reliable sealing as in factory-sealed containers, and also provide tightness against entry of micro-organisms, and that the containers possess the barrier properties requisite for their contemplated application. The requirement of tightness against micro-organisms such as, for example, bacteria or other pathogenic organisms must be met even if the requirement entails problems in design, filling and original—or factory—sealing of the containers. In certain fields of application, these difficulties are further aggravated by the fact that the containers must be acceptable for hot filling and/or must be able to withstand heat-treatment after filling, for example for pasteurization or autoclaving. In particular in heat-treatment, the connection between the container body proper and its seal is, in a factory-sealed container, exposed to great stresses which may lead to leakage. During cooling of the heat-treated container with its contents, pressure differences arise, moreover, between the interior of the container and its ambient surroundings, which, at least under certain phases of the cooling process, entails that a partial vacuum prevails in the container, with a subsequent risk that micro-organisms can be drawn into the container even for the very smallest leaks in the closure.

In order for a new container to be approved as suitable for use for long storage life of foods, for example, conserved and preserved foods, it is required that a large number of container samples of the type under consideration be manufactured and scrutinized. Such scrutiny relates also to the long-term tightness of the containers and it is, therefore, a costly and substantial procedure before a new type of container can be put out on the market. It is necessary that such a scrutiny for a new type of packaging comprise at least 100,000 containers in order to provide a reliable basis for an assessment of the quality and tightness of the new type of packaging. It is also obvious that such careful scrutiny is particularly necessary for packagings intended for the long-term storage of foods, since any degree of untightness against bacteria and micro-organisms would result in deadly consequences for the consumer of foods attacked by pathogenic or toxicogenic micro-organisms, particularly under such unfortunate circumstances that the taste of the food involved is not influenced to such an extent as to forewarn against consumption.

SUMMARY OF THE INVENTION

The present invention seeks to provide a container which satisfies the above-outlined requirements and obviates the drawbacks which are inherent in prior Art technology.

The present invention contemplates a resealable container with a container body and an outer lid, hereinafter designated the first lid, in which the container body is provided with an anchorage portion placed in the opening portion of the container body and extending along at least a portion of the circumference thereof, the anchorage portion being united, in a sealing and permanent connection, with a corresponding anchorage portion on the first lid. The novel feature of the present invention is that at least one further lid is sealingly fixed to the container body in a region inside the first lid, whereby there is formed, in the factory-sealed container, at least one sealed space defined by adjacently located lids and by the container body.

In one preferred embodiment of the present invention, the first lid is provided with a weakened portion which is located inside the connection of the first lid to the anchorage portion of the container body. The weakened portion is oriented in the circumferential direction of the first lid and extends along at least a portion of the circumference of the lid. In preferred embodiments of the present invention, both the weakened portion and the permanent connection between the first lid and the anchorage portions of the container body, respectively, extend about the entire circumference of the opening portion of the container body.

In a further preferred embodiment, the second lid or lids are fixed to the container body in strip-off mode, and, as a rule, are fixed to a shoulder disposed in the circumferential direction of the container. In one preferred embodiment, the second lid or lids are provided with gripping means, preferably designed as a flap which projects from the defining edge of each respective lid and, in the factory-sealed container, assumes a position in which at least the tip of the flap is places to facilitate its being gripped, which, as a rule, entails that the flap is in a position in which it is not in contact with the wall of the container body.

In yet a further preferred embodiment, the first lid is provided with a stripping device, in which there is included a pull-ring. The pull-ring of the stripping device is, in one preferred embodiment, located on one side of a fixing member for the first lid, and the stripping device is provided, on the opposite side of the fixing member, with a broaching device. The fixing to the first lid is located such that when the pull-ring is raised, a fulcrum effect is created for amplifying the forces with which the stripping device broaches the connection in the weakened portion of the lid and thereby commences the release of a central lid portion for the opening of the factory-sealed container.

In preferred embodiments of the present invention, one or more layers of barrier material are included in both the container body and in at least one of the lids, these layers being, in certain physical applications, surrounded by layers of plastic material. The layer facing the storage compartment of the container consists of a material which has been approved for contact with the goods which are intended for storage in the container. In certain physical applications, the layer is replaced by a coating which, for example, is sprayed onto the surfaces of the plastic material. Examples of barrier materials are aluminum, ethylvinyl alcohol, polyvynil dichloride etc.

BRIEF DESCRIPTION OF THE FIGURES OF THE DRAWING

The present invention and its features will become more readily understood from the accompanying drawing, and the detailed description relating thereto.

In the accompanying drawing.

DETAILED DESCRIPTION

Figure 10:
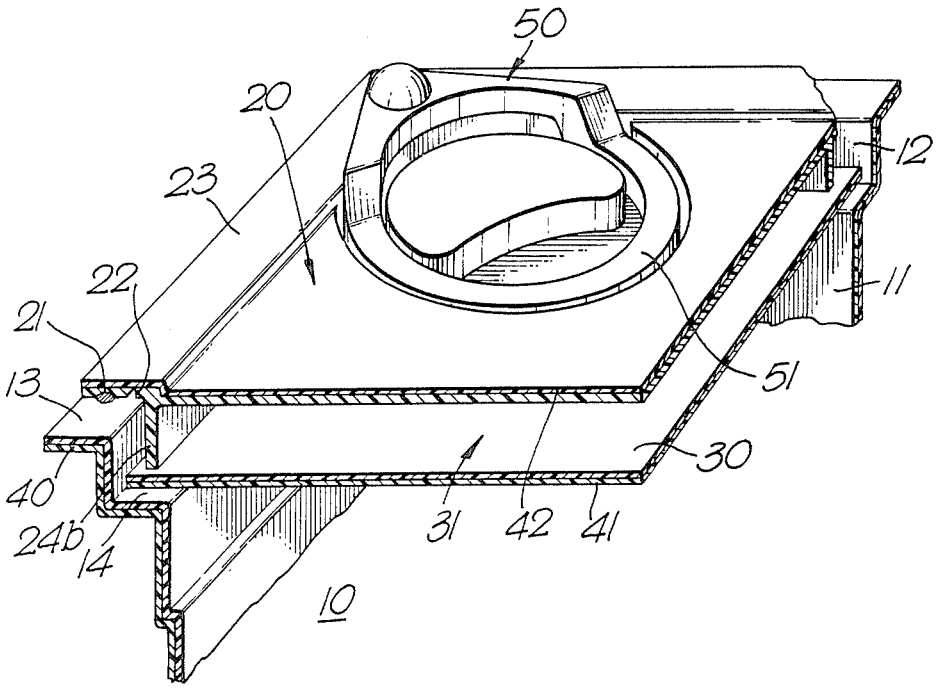
FIG. 10 is a cut-away portion of a factory-sealed container.
Figure 11:
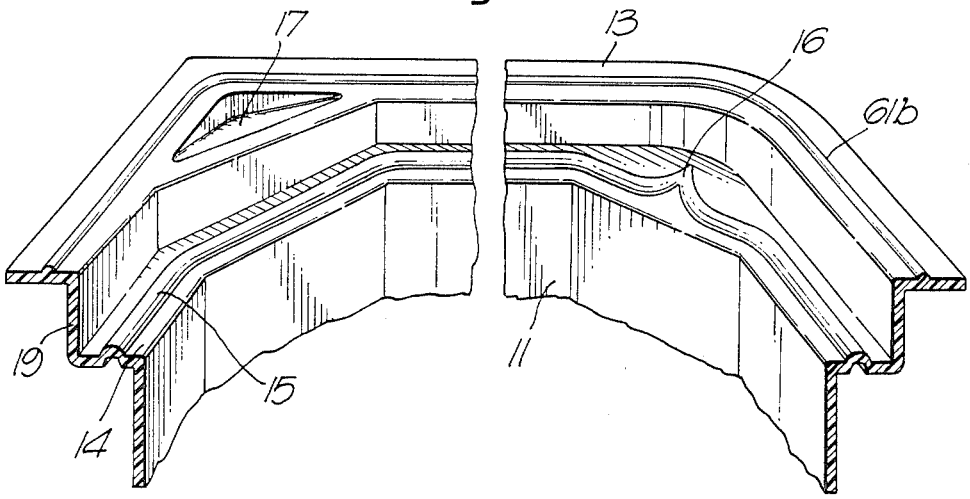
FIGS. 11–12 are perspective views of part of the opening portion of the container body in different embodiments, in areas where the removal of each respective lid is commenced on the opening of the factory-sealed container.
Figure 12:
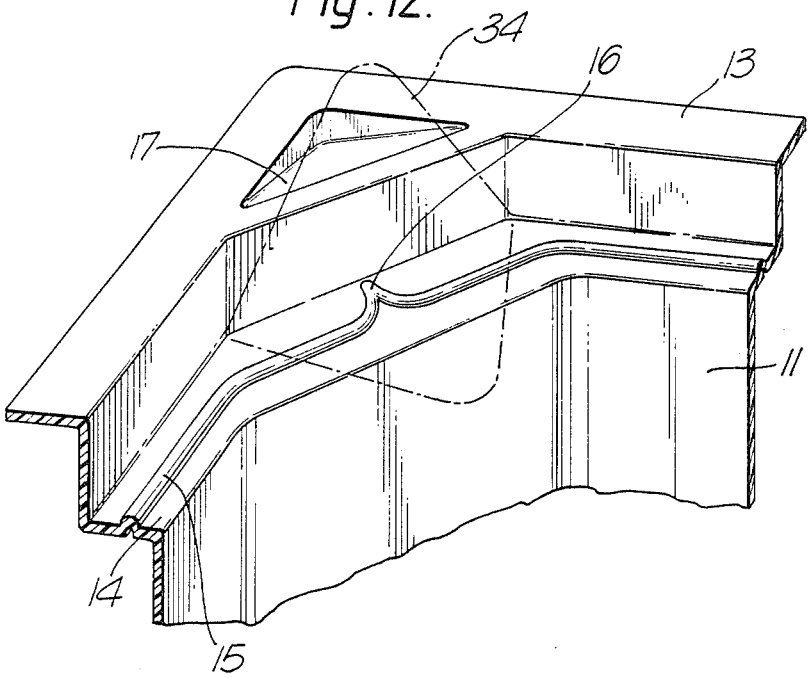

Referring to the drawing, different embodiments of a container are shown comprising a container body 11 and a bottom portion 18. The container body has an opening 12 which is bounded by a rim serving as an anchorage portion 13 for a first lid 20. In the illustrated embodiments, the container body is provided with a shoulder 14 which extends in the circumferential direction of the container and, in a preferred embodiment, throughout the entire circumference of the container. As seen in FIGS. 11 and 12, the shoulder 14 is provided with at least one upwardly directed bead 15 which has a bulge 16 in a region where stripping of a second lid 30 fixedly anchored to the bead is commenced. In certain embodiments, the material of a wall portion 19 between the shoulder 14 and the anchorage portion 13 is preferably oriented substantially in the axial direction of the container body. FIGS. 11 and 12 also show embodiments in which the anchorage portion 13 of the container body is provided with a recess 17. FIG. 11 shows one embodiment in which the recess 17 and the bulge 16 are located in respective offset corner regions of the container, while FIG. 12 shows an embodiment in which the recess 17 is located adjacent to the bulge 16. In FIG. 12, second lid 30, to be described in greater detail hereafter, consists of a transparent material. In certain embodiments, the container body is provided as seen in FIG. 10 with a layer of barrier material 40, which, for example, consists of aluminum foil, ethylvinyl alcohol, polyvinyl dichloride etc.

Figure 1:
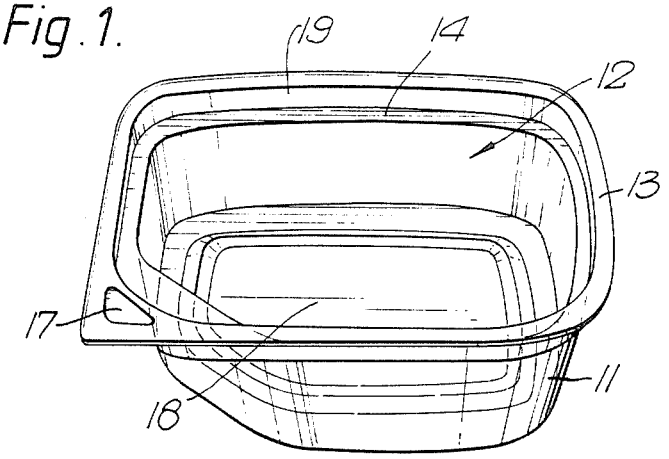
FIG. 1 is a perspective view of a container body.
Figure 2:
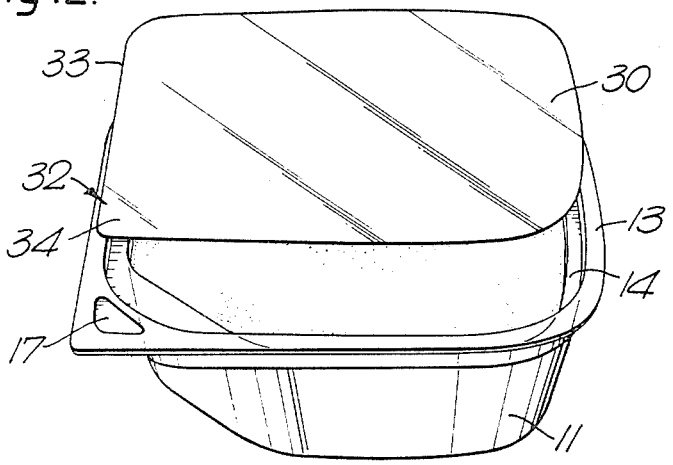
FIGS. 2 and 3 show an inner lid about to be mounted in place and fixed in place, respectively, on the container body.
Figure 3:
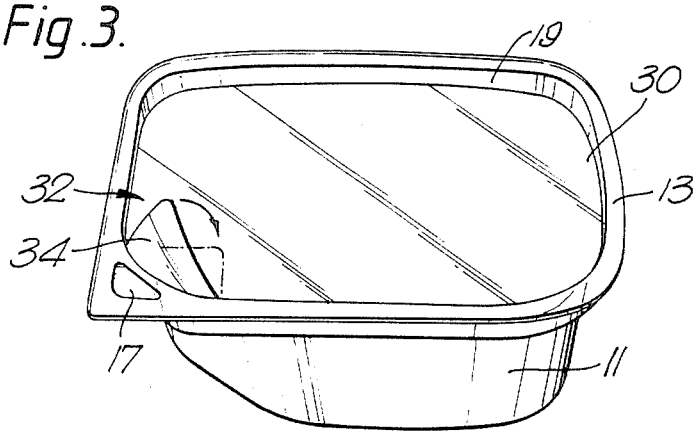
Figure 4:
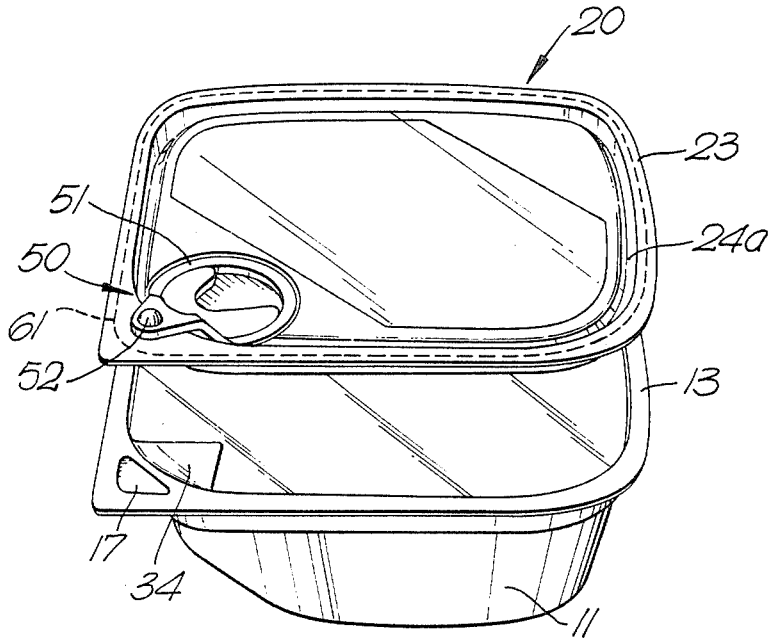
FIGS. 4 and 5 show corresponding positions for an outer lid.
Figure 5:
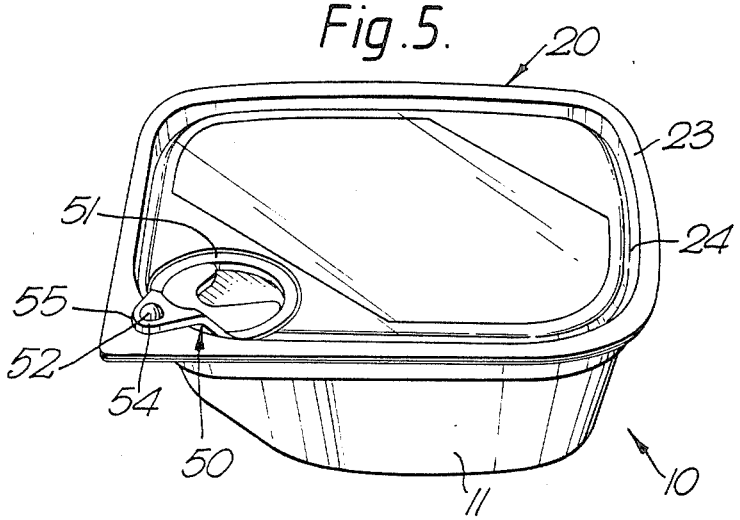

Referring to FIGS. 2–4, therein is seen the second lid 30 which constitutes an inner lid or membrane, whose dimensions are adapted to the opening of the container body, in order to be sealingly fixed in the opening, for example, at the shoulder 14. In one preferred embodiment of the present invention, such fixation is effected against the bead 15, for example, by heat sealing. The second lid is provided with a gripping member 32 at its bounding edge 33, which is constructed as a flap 34, but which may also consist of a folded-over portion of the edge 33 which extends along a shorter or longer extent of the circumference of the second lid 30. In certain embodiments, a layer of barrier material 41 cf FIG. 10 is included in the second lid, for example, barrier material of the above-described type.

The first lid 20 serving as an outer lid is provided with an anchorage portion 23 corresponding to the anchorage portion 13 of the container body and aligned therewith at the periphery of the lid 20. The anchorage portion 23 is connected, via a weakened portion (stripping line) 22, cf. FIGS. 10–16, with a central lid portion 29 which, on opening of the container, constitutes that portion of the lid which is removed from the container. The central lid portion of the first lid is, as a rule, provided, in the region adjacent the stripping line 22, with a depending portion 24*a,b* (cf. FIGS. 4, 13, 14 and 15) the depth of which is adapted to shoulder 14, such that the depending portion extends into proximity with the second lid 30 in the region of the shoulder 14. The anchorage portion 13 of the container body is sealingly connected to the anchorage portion 23 of the first lid by a permanent connection 21 which, in one preferred embodiment of the present invention, consists of a welded joint realized by ultrasonic welding. In order to locate the welded joint and facilitate its formation, at least one of the anchorage portions 13, 23 is provided with at least one welding cam 61 facing the other anchorage portion. In certain embodiments, lid 20 also includes a layer 42 cf FIG. 10 of barrier material, for example of the above-indicated type.

Also seen in the drawings is an embodiment of the invention in which the first lid 20 is provided with a stripping device 50 fitted with a pull-ring 51 located on one side of the fixation region 52 of the stripping device to the first lid 20, while, on the other side of the fixation region, the stripping device is provided with a projecting portion 54 which, in one referred embodiment, terminates in its end region by an edge 55 facing the outer surface of the first lid. The stripping device consists of a relatively rigid material, preferably a plastic material. Since the distance between the fixation region 52 and the gripping portion of the pull-ring 51 is greater than the length of the projecting portion 54, a fulcrum effect will be created when the pull-ring is raised which facilitates rupture along the weakened line 22.

Figure 14A:
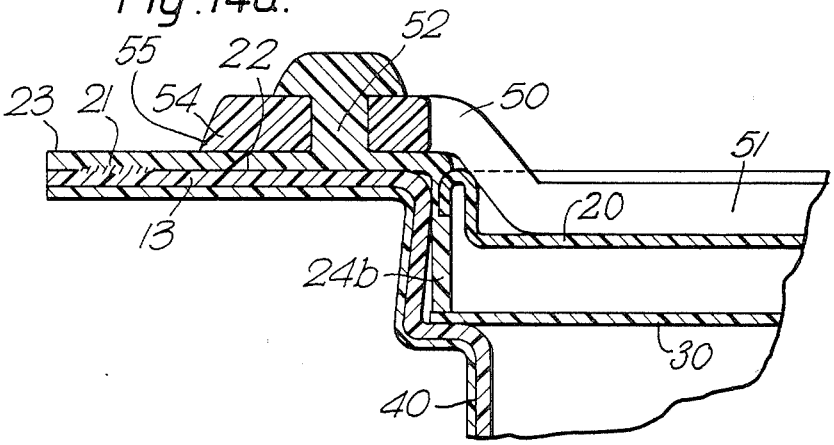
FIGS. 14*a*, 14*b* and 15*a*, 15*b* are partial sections of different embodiments of the opening portion of a factory-sealed container in areas where the opening of the factory-sealed container is commenced.
Figure 14B:
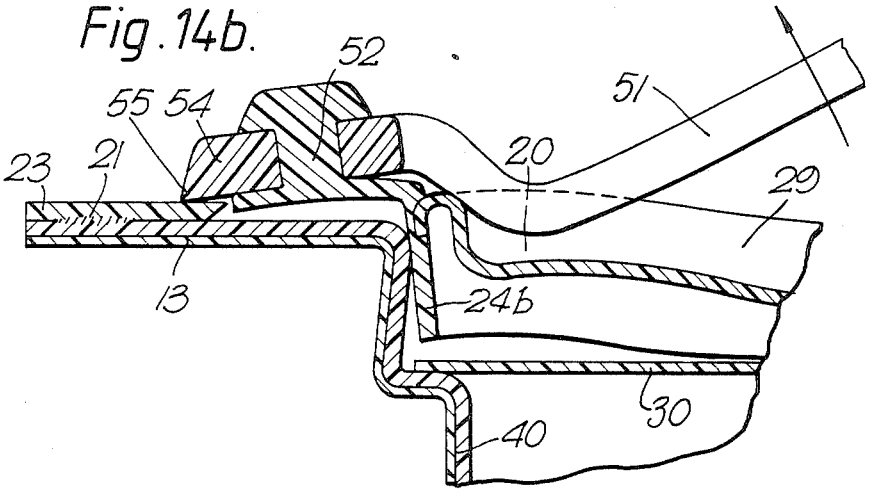
Figure 15A:
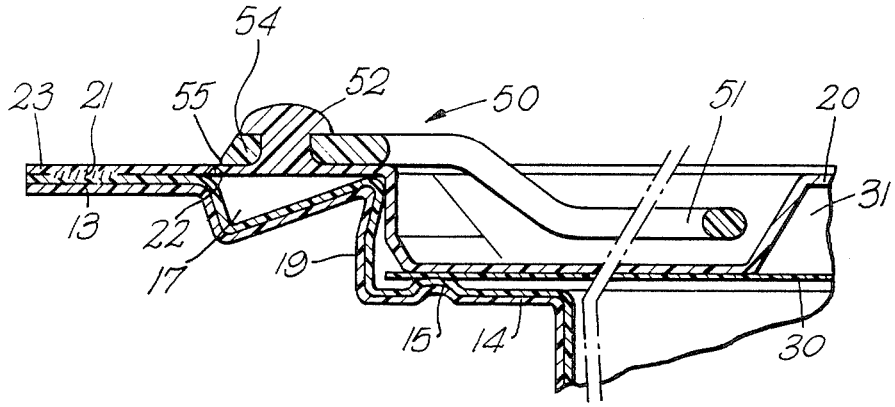
Figure 15B:
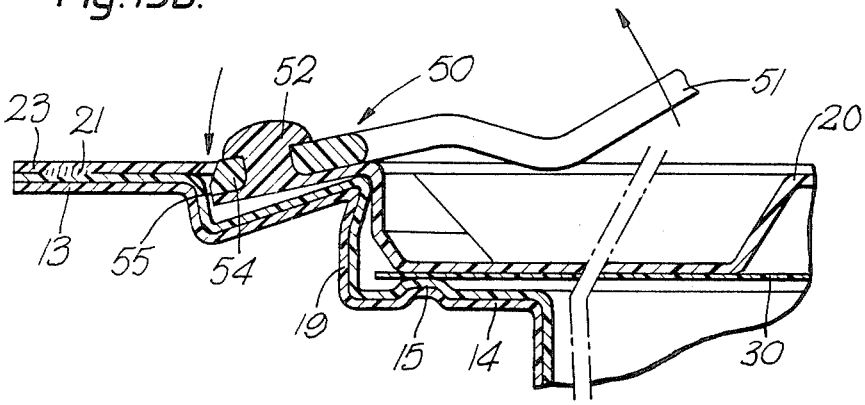

FIGS. 14*a* and 14*b* show an embodiment of the stripping device in which its projecting portion 54 covers the weakened portion 22 and terminates between portion 22 and the outer edge of the anchorage portion 23, while FIGS. 15*a* and 15*b* show an embodiment in which the edge 55 of the stripping device is positioned adjacent the weakened portion 22 and, as a rule, slightly inside this portion. In this latter case, the edge 55 of the stripping device will, on opening of the container, act as a pressure member which breaks the material of the weakened portion. The attachment of the stripping device to the first lid is normally obtained by a rivet of plastic material.

Figure 16:
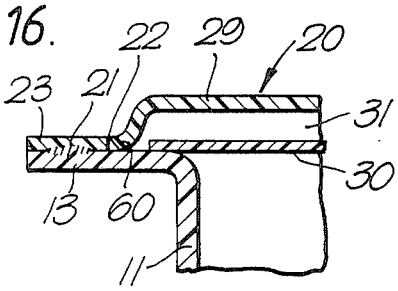
FIG. 16 is a partial section of yet a further alternative embodiment of the opening portion and the lid of a factory-sealed container.

FIG. 16 illustrates an embodiment in which the anchorage portion 23 of the first lid 20 is depressed in relation to the central lid portion 29 of the first lid. Adjacent the weakened portion 22, the outer region of the central lid portion is located substantially in a plane with the anchorage portion 23 so as to form a support 60 which, in the factory-sealed container, abuts against the anchorage portion 13 of the container body. The total extent (width) of the anchorage portion 23 and support 60 of the first lid in a direction towards the central axis of the container is less than the corresponding extent (width) of the anchorage portion 13 of the container body, whereby a space will be formed, as shown in FIG. 16, so that the second lid 30 can rest on the anchorage portion 13 of the container body. In certain embodiments in which the distance between the two lids must be relatively great, the second lid 30 is fixed to the container body 11 in a region which is located beneath the anchorage portion 13, for example against shoulder 14.

In the above-described embodiments, the container body is illustrated with only one shoulder 14, but it is obvious to a person skilled in the art that more than one such shoulder is provided in certain physical applications where more than two lids are required. Concerning the weakened portion 22, this has been shown as formed by a groove-like recess, but it is obvious that, in certain embodiments, the weakened portion may be formed by treating the plastic material in the region in question so as to reduce the strength of the material, for example by heat treating the material to alter the crystallinity of the material. Similarly, although the weakened portion is illustrated as a closed loop, it is obvious that, in certain applications, the weakened portion may be disposed only at one section of the circumference of the container opening so that, upon opening of the container, the central lid portion 29 of the first lid 20 will remain anchored to the container body.

Figure 6:
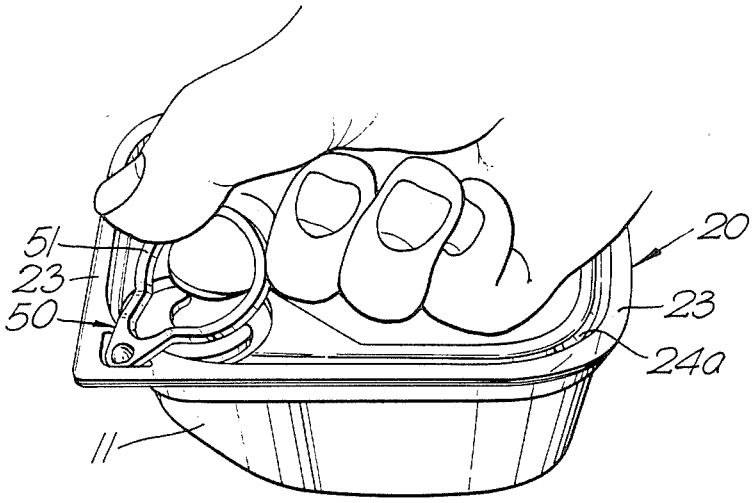
FIGS. 6 and 7 show the initial phase and the continued phase, respectively, of the removal of a central lid portion of the outer lid on the opening of a factory-sealed container.
Figure 7:
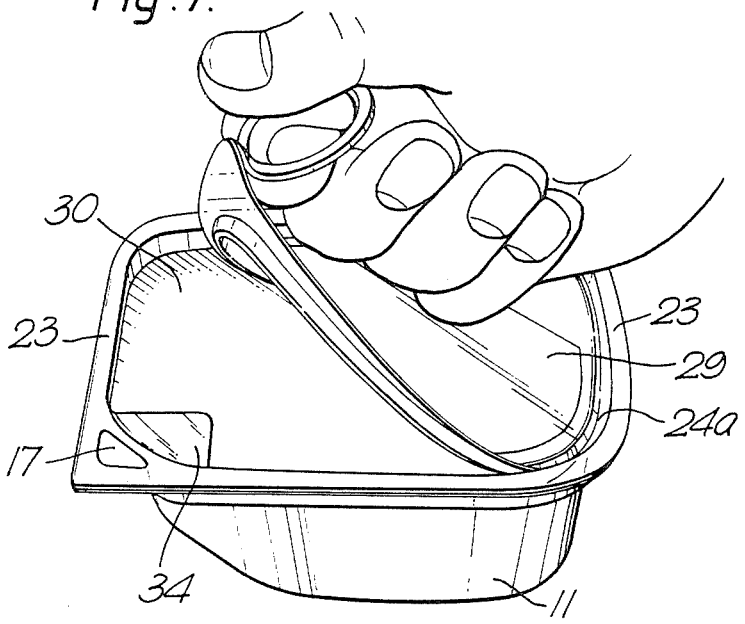
Figure 8:
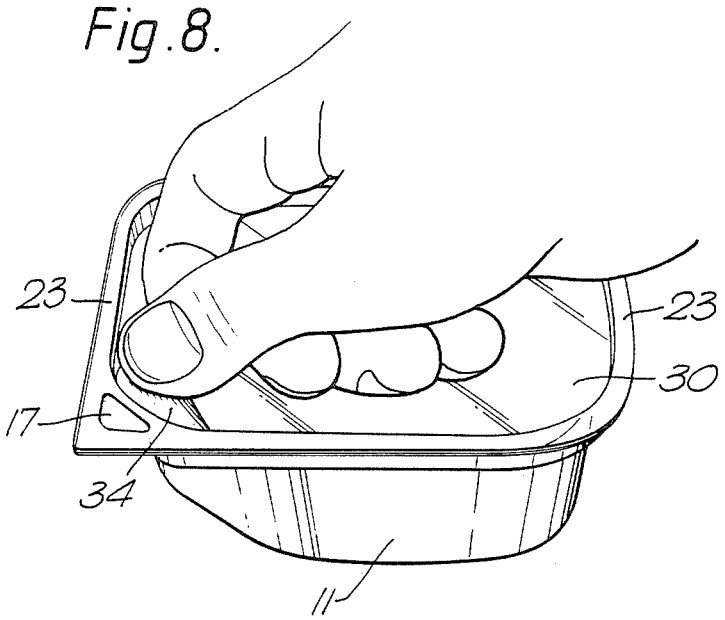
FIGS. 8 and 9 show corresponding positions for the removal of the inner lid.
Figure 9:
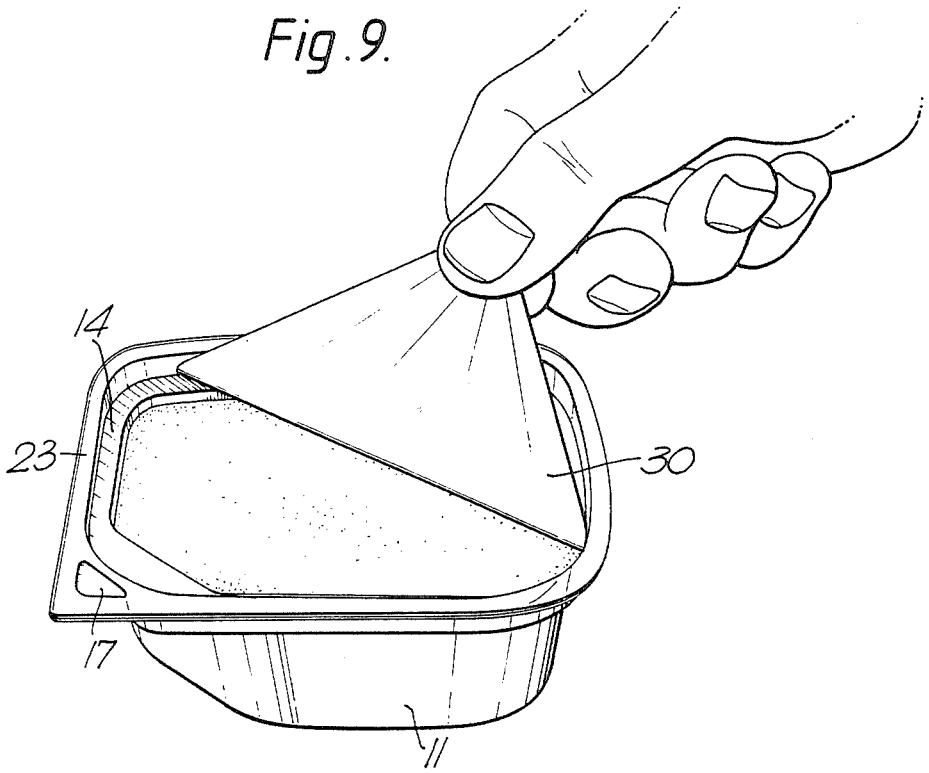

When a container according to the present invention is to be put into use, it is filled with the desired goods, whereafter the second lid 30 is mounted in place and sealingly fixed against the container body 11. Thereafter, the first lid 20 is applied and also sealingly fixed to the container body 11. There is then formed, between the first lid 20 and the second lid 30, an enclosed and sealingly defined region 31. When the container is opened, the central lid portion 29 of the lid 20 is first removed, this being effected, in the illustrated embodiments, by means of the stripping device 50. When the pull-ring 51 is raised, the stripping device breaks the connection of the lid to the anchorage portion 23, in that the weakened portion 22 is pierced and/or ruptured. When portion 22 has been severed, only relatively small forces are required for the continued removal of the lid (cf. FIGS. 6 and 7). Once the central lid portion 29 of the first lid has been removed, the second lid 30 is removed by means of the gripping device 32. The container is thereafter fully open and its contents may be used.

The central lid portion 29 of the first lid 20 is suited for reclosure of the container in that the depending portion 24*a*, 24*b* constitutes an arrest means which cooperates with shoulder 14 to restrict downward movement of the central lid portion in the container. This applies particularly when the weakened portion is placed substantially in registry with the inner surface of the wall portion 19 of the container body. In certain embodiments, the weakened portion 22 is so located that, when it has been severed, there remains, from the central lid portion of the lid, a flared flange which, in cooperation with the anchorage portion 13 of the container body, restricts movement of the lid portion towards the bottom of the container. As a rule, the depending portion 24 *a,b* of the lid portion is dimensioned so as to abut against the inner wall surface of the opening portion and thereby realize a sealing upon reclosure of the container.

Figure 13:
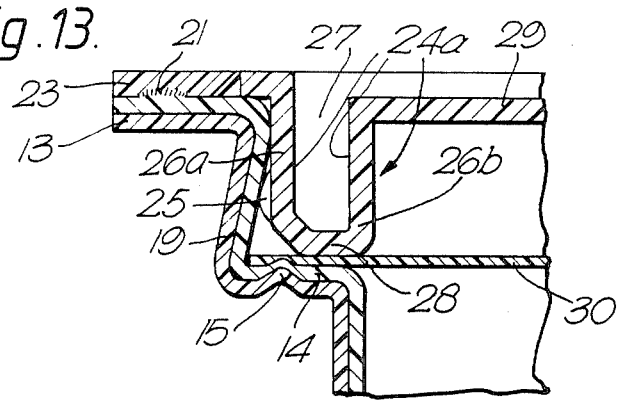
FIG. 13 is a partial section of one embodiment of the opening portion and the lid of a factory-sealed container.

FIG. 13 illustrates an embodiment of the first lid 20 whose depending portion 24*a* includes one or more projecting portions 25 which cooperate with the substantially vertical wall portion 19 of the container body in the region between the shoulder 14 and the anchorage portion 13 in order to provide a snap engaging function with the wall portion. To this end, the wall portion 19 is slightly inclined downwardly and outwardly. In order to attain a certain spring action in the portion 24*a* of the first lid, this portion is, in the embodiment illustrated in FIG. 13, composed of two substantially vertical wall portions 26*a,b* which are interconnected by a substantially horizontal wall portion 28 which, together with the vertical wall portions, forms a channel-like groove 27. This described construction also allows the first lid to be manufactured by thermoforming.

For containers of the type now under consideration, the risk of leakage between the interior of the container and its ambient surroundings is so manifestly determined by the security. and reliability of the sealing of the container that the quality of the seal is wholly determinative of the likelihood of possible leakage in the factory-sealed container. The above-described construction of the container, in which it is sealed with at least two lids, entails that the number of containers which need be subjected to long-term testing before a new type of container can be approved is considerably less than in prior art techniques. The construction with at least two lids entails, clearly, that leakage between the storage compartment of the container and its ambient surroundings will only occur if leakage arises simultaneously in all seals. Since, according to the new technique, each lid, on factory-sealing of a container, is sealed against the container body in one process and with equipment which, in all essentials, is wholly separate from the equipment in which each subsequent lid is sealed against the same container body, the quality—and thereby the tightness—of each separate seal created on sealing of the container is independent of the others. Normally, one seal of faulty quality will only be created in the event of malfunction in the sealing equipment or in the event of defects in the container body or lid, respectively. In this context, it should be observed that, in certain physical applications, the seals are effected using different techniques, for example one seal by means of hot welding and one by means of ultrasonic welding.

Thus, it is statistically possible to establish the risk of leakage between the storage compartment of the container and its ambient surroundings by first, long-term tests, empirically establishing the likelihood of leakage in each respective seal, whereby the statistically determined likelihood of leakage in the container is calculated as a product of the empirically established probabilities. If one such long-term test relates, for example, to containers with two seals, and if the likelihood of leakage has been empirically established at 1:1,000 for each respective seal, one container in a million will, in statistical terms, display leakage.

In FIG. 11, the regions for initiation of the opening of the first lid 20 and the opening of the second lid 30, respectively, are located in spaced apart relationship. This entails that the central lid portion 29 of the first lid must be lifted a relatively great distance before the gripping member 32 of the second lid becomes accessible, with the result that any unauthorized tampering with container will readily become noticeable. Moreover, the above-disclosed location of the opening regions entails that the cross-sectional area for the filling space is reduced less than in the embodiment illustrated in FIG. 12.

In the drawing, the containers have been illustrated with polygonal cross-section. However, it is obvious to a person skilled in the art that the present invention is applicable also to containers of any optional cross-sectional configuration, for example circular, oval, or combinations which include parts of polygonal and curved lines.

It is clear that the novel technique disclosed by way of the present invention improves the possibilities of marketing new packaging types, since the number of packages of a new construction which must be tested in order that it be possible to ascertain the probability of leakage in such containers is considerably less than has hitherto been the case. Thus, this novel technique obviates the withholding effect which the need of extensive and costly long-term tests of a large number of containers has involved.

The above detailed description has referred to a limited number of embodiments of the present invention, but those skilled in the art will readily perceive that the present invention contemplates a large number of embodiments which fall within the spirit and scope of the appended claims.

I claim:

1. A container comprising a container body having a closed bottom and an open top, a first lid, first anchoring means including a permanent joint uniting and sealingly securing said first lid to said container body along a circumferential line of permanent sealing to close and permanently seal said open top of the container body, a second lid, second anchoring means sealingly securing said second lid to said container body in spaced relation within said first anchoring means along a respective circumferential line of sealing, said first and second lids, which are sealed to the container along their respective circumferential lines of sealing, forming a sealed space in said container body between said lids and means for separating said first lid from said container body to provide access to said second lid, said second lid being separable from said container body at said second anchoring means.

2. A container as claimed in claim 1 wherein said second anchoring means comprises a peelable connection between the second lid and the container body to enable removal of the second lid from said container body.

3. A container as claimed in claim 2 wherein said second lid includes a gripping means for being engaged to remove the second lid from said container body, said gripping means being located in said sealed space.

4. A container as claimed in claim 3 wherein said container body includes a shoulder at said open top surrounding the opening thereof, said second lid being attached to said container body at said shoulder.

5. A container as claimed in claim 4 wherein said first lid includes a depending projection extending towards said bottom of the container to a position adjacent said second lid in a region proximate to said shoulder.

6. A container as claimed in claim 4 wherein said gripping means includes a flap on said second lid which has a tip which is freely exposed and capable of being grasped to remove the second lid from the container body.

7. A container as claimed in claim 6 wherein said shoulder includes a bead against which said second lid is fixed, said bead including a bulge in the region of said flap to facilitate separation of the second lid from the container body at said second anchoring means.

8. A container as claimed in claim 1 comprising layers of barrier material on said container body and said lids.

9. A container as claimed in claim 1 wherein said means for separating said first lid from the container body comprises a weakened portion in said first lid disposed interiorly of said first anchoring means and extending at least partially around said open top, said first lid being separable from said container body along said weakened portion by severance thereof.

10. A container as claimed in claim 9, wherein said container body has a recess, said recess being located in proximity to said open top, said weakened portion in sa1d first lid extending over said recess.

11. A container as claimed in claim 10 comprising stripping means including a pull member on said first lid for rupturing said weakened portion in said first lid by pulling on said pull member.

12. A container as claimed in claim 11 wherein said stripping means bears against said first lid at a fulcrum when said pull member is pulled so that the force applied to said pull member is amplified and applied to said weakened portion of said first lid.

13. A container as claimed in claim 12 wherein said stripping means includes a projecting portion in opposition to said pull member and extending above said recess in said container body.

14. A container as claimed in claim 1 wherein said first anchoring means comprises a welded joint.

15. A container as claimed in claim 5 wherein said depending projection includes means for providing snap engagement between said first lid and said container body.

* * * * *